US006347900B1

(12) United States Patent
Sadakata et al.

(10) Patent No.: US 6,347,900 B1
(45) Date of Patent: Feb. 19, 2002

(54) YOKE FOR UNIVERSAL JOINT, AND PRODUCTION PROCESS FOR THE SAME

(75) Inventors: Kiyoshi Sadakata, Gunma-ken; Yoshihide Sasamoto, Maebashi; Shuji Hitani, Atsugi, all of (JP)

(73) Assignees: NSK Ltd., Tokyo; Otsuka Koki Co., Ltd., Yokohama, both of (JP)

( * ) Notice: Subject to any disclaimer, the term of this patent is extended or adjusted under 35 U.S.C. 154(b) by 0 days.

(21) Appl. No.: 09/717,004

(22) Filed: Nov. 22, 2000

Related U.S. Application Data

(63) Continuation of application No. 09/018,186, filed on Feb. 4, 1998, now abandoned.

(30) Foreign Application Priority Data

Feb. 10, 1997 (JP) ..... 9-26676

(51) Int. Cl.[7] ..... F16C 11/06; B26F 1/14; B21D 31/00

(52) U.S. Cl. ..... 403/74; 29/897.2; 29/558; 72/379.2; 83/35; 83/83; 83/684

(58) Field of Search ..... 403/74, 157, 57; 29/897.1, 558; 72/379.2; 83/51, 50, 35, 83, 681, 684, 686

(56) References Cited

U.S. PATENT DOCUMENTS 2,067,283 A * 1/1937 Padgett ..... 29/897.2
3,724,305 A * 4/1973 Kondo ..... 80/688
3,878,746 A * 4/1975 Carmeli ..... 83/51
4,361,024 A * 11/1982 Haldric ..... 72/397
4,477,537 A * 10/1984 Blase et al. ..... 83/51
4,869,969 A * 9/1989 Pavlov et al. ..... 428/572
5,105,696 A * 4/1992 Baubles ..... 83/50
5,163,223 A * 11/1992 Wurster ..... 29/874
5,247,862 A * 9/1993 Haak ..... 83/27
5,320,013 A * 6/1994 Nonami et al. ..... 83/25
5,845,394 A * 12/1998 Abe et al. ..... 29/897.2

* cited by examiner

*Primary Examiner*—Lynne H. Browne
*Assistant Examiner*—Kenn Thompson
(74) *Attorney, Agent, or Firm*—Miles & Stockbridge P.C.

(57) ABSTRACT

A yoke for a universal joint is produced by press forming of a steel sheet, and mutually concentric circular holes are formed by press punching at the tip ends of a pair of arms opposite to each other. After the circular holes are punched by inserting a punching punch through the tip ends of the arms in the state that the backs of the arms are supported by a die relative to the punching direction and the outer peripheries of these arms are restrained by a restraining member in the vicinity of a portion in which the circular holes are to be formed, a finishing punch is inserted from the direction opposite to the punching punch into the punched circular holes, thereby improving the accuracy of the circular holes.

12 Claims, 6 Drawing Sheets

YOKE FOR UNIVERSAL JOINT, AND PRODUCTION PROCESS FOR THE SAME

CROSS REFERENCE TO RELATED APPLICATIONS

This application is a continuation of U.S. application Ser. No. 09/018,186, filed Feb. 4, 1998 (abandoned).

This application also claims the benefit of Japanese Patent Application No. 9-26676, which is incorporated herein by reference.

BACKGROUND OF THE INVENTION

1. Field of the Invention

The present invention relates to a yoke for a universal joint and a production process for the same.

According to the present invention a yoke for a universal joint and a a yoke for a universal joint which is, for example, to be incorporated into a joint portion between a pair of steering shafts for forming a steering apparatus, can be attained by simple press working at low cost.

2. Related Background Art

In a joint portion between the steering shafts of a steering apparatus, there is provided a universal joint 1 as roughly shown in FIG. 7 so that a pair of steering shafts 2, 2 not existing on one straight line are connected with each other to enable transmission of rotational force between these two steering shafts.

Such universal joint 1 is formed by connecting a pair of yokes 3, 3 to each other by one cross shaft 4 so as to allow rockable displacement thereof. Each of these yokes 3, 3 has a pair of arms 5, 5 formed in a U shape and opposite to each other. Mutually concentric circular holes 6, 6 are formed at the tip ends of these arms 5, 5. Inside each of these circular holes 6, 6, the end portion of said cross shaft 4 is supported by a radial needle bearing to allow rockable displacement.

In order to reduce the cost of the universal joint 1 which is described above, each of the yokes 3, 3 is produced by press working of a steel sheet. When the yoke 3 is to be produced by press working, a steel sheet which has been punched into a predetermined shape is bent to a U shape to form the pair of arms 5, 5, and then the above-mentioned circular holes 6, 6 are formed at the tip ends of each of these arms 5, 5. In order to sufficiently reduce the cost of the yokes 3, 3, it is preferable to carry out the work for forming the circular holes 6, 6 at the tip ends of each arm 5, 5 by press punching, and not by, for example, cutting work using a drilling process.

On the other hand, in order to maintain the performance of the universal joint 1, it is necessary to sufficiently increase the coaxiality, the circularity, the inclination, the size accuracy including that of the inner diameter, and the configuration accuracy of the circular holes 6, 6. Because a bearing cup for forming the radial needle bearing is fitted in and fixed to each of these circular holes 6, 6, if the accuracy of any of the above-mentioned items of the circular holes 6, 6 is not sufficiently high, the support portion of the cross shaft 4 may rattle, or this support portion 4 may not rock smoothly, or, a sealing performance of the radial needle bearing portion is deteriorated, which is not desirable since the operability or durability of the steering apparatus incorporating the universal joint 1 is worsened.

FIG. 8 shows a state in which the circular holes 6, 6 are formed at the tip ends (the upper end portions of FIG. 8) of the arms 5, 5 of the yoke 3 by normal press working. The formation of these circular holes 6, 6 by press is conducted by piercing a pair of punches (punchers) into the tip ends of these arms in the state that a die (counter punch) is kept inserted between the paired arms 5, 5. Of the circular holes 6, 6 formed by such normal press working, cylindrical surfaces 8, 8 having comparatively high accuracy are formed on the outer half surfaces into which the punching punches are to be inserted. On the other hand, on the inner half surfaces thereof which are the sides opposite to the die, there are provided conic concave break planes 9, 9 which are unstable in configuration, dimensions, and roughness. The performance of the universal joint having by the yoke 3 in which the circular holes 6, 6 including such break planes 9, 9 (with low accuracy) are formed is poor, as described above.

On the other hand, conventionally, in order to form accurate holes by press working, the punching punch is pressed against the die while environs of the circular holes to be formed are restrained by a part of the steel sheet to be processed in the direction of the thickness. Further, it is known that the accuracy of the circular holes to be formed by press working can be securely obtained by adjusting a clearance between the punching punch and the die, or contriving the configurations of the edge portions of the punching punch and the die.

However, in the case of the universal joint 1 to be incorporated in a steering apparatus, the width W7 of the tip end partition walls 7, 7 provided between the tip end outer periphery of the arm 5, 5 and the peripheral portion of the circular hole 6, 6 is made to be small in order to reduce the size and the weight of the joint. For this reason, it is difficult to securely obtain a sufficient force for restraining the peripheral portions of these circular holes 6, 6 when the circular holes 6, 6 are punched. That is, if this force is increased, a great interfacial pressure acts in the direction of the thickness of each of the tip end partition walls 7, 7 having the small width W7, so that the thickness T7 of each of the tip end partition walls 7, 7 deviates from the regulation value.

Since the above-mentioned restraining force can not be securely obtained for such reason the coaxiality, the circularity, the inclination, and the size accuracy including that of the inner diameter of the circular holes 6, 6, and thus the performance of the universal joint 1 formed by the yokes 3, 3 with the circular holes 6, 6 provided at the tip ends thereof are deteriorated. Accordingly, it is difficult to actually adopt such universal joint in a steering apparatus of a motor vehicle.

SUMMARY OF THE INVENTION

A yoke for a universal joint and a production process of such yoke according to the present invention were contrived to utilize punching work by press working at low cost and to prevent the deterioration of accuracy of the circular holes which is associated with the deterioration of performance mentioned above, thereby being broadly suited to the production of a steering apparatus of a motor vehicle.

A and after for a yoke a for universal joint according the present invention is produced by press forming of a steel sheet, in the same manner of a conventionally-known yoke for universal joint, and mutually concentric circular holes are formed by press punching at the tip ends of a pair of arms opposite to each other.

In the yoke for a universal joint of the present invention, after said circular holes are provisionally by inserting a punch through the tip ends of said arms in the state that the backs of said arms are supported by a die relative to the punching direction and the outer peripheries of these arms are restrained by a restraining die in the vicinity of a portion in which said circular holes are to be formed, a finishing punch is inserted from the direction opposite to the first memory punch into the provisionally punched circular holes, thereby improving the accuracy of said circular holes.

Also, a production process of a yoke for universal joint according the present invention includes a question to produce, after forming a pair of arms opposite to each other by bending a steel sheet by press forming, mutually concentric circular holes by press punching at the tip ends of these arms, also in the same manner as a conventionally-known production process of a yoke for universal joint.

In the production process of the present invention after provisionally punching said circular holes by inserting a punching punch through the tip ends of said arms in the state that the backs of said arms are supported by a die relative to the punching direction and the outer peripheries of these arms are restrained by a restraining member in the vicinity of a portion for forming said circular holes, a finishing is inserted from the direction opposite to the first mentioned punch into the provisionally punched circular holes, thereby improving the accuracy of said circular According to the yoke for universal joint and the process of producing such yoke of the present invention arranged as described above, the punching work is conducted by a low-cost press working so as to prevent the deterioration of accuracy of the holes which is associated with deterioration of performance mentioned above. As a result, an inexpensive universal joint with high performance can be obtained.

DESCRIPTION OF THE PREFERRED EMBODIMENT

Figure 1:
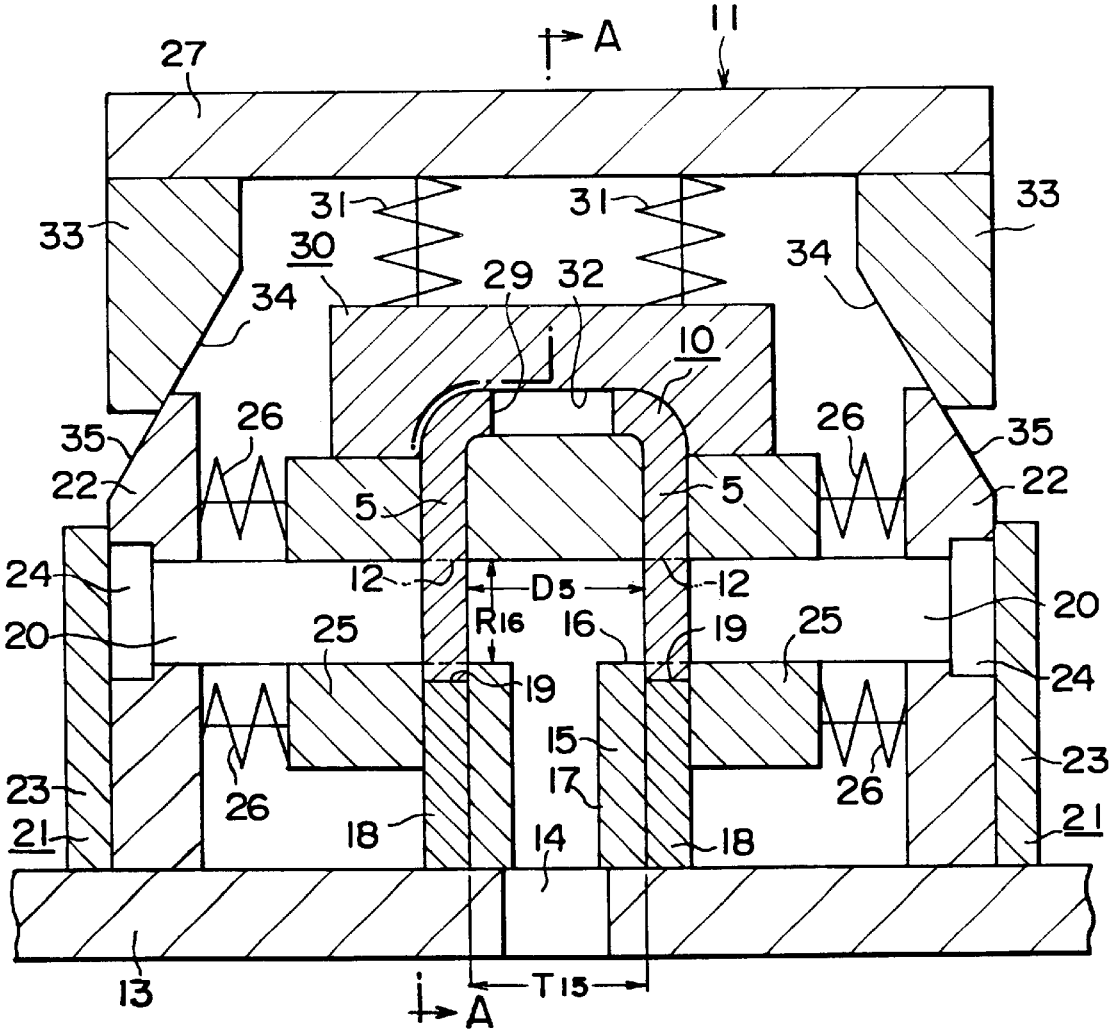
FIG. 1 is a longitudinal cross sectional view of a punching machine for forming blank holes at the tip ends of arms constituting a first yoke element.
Figure 2:
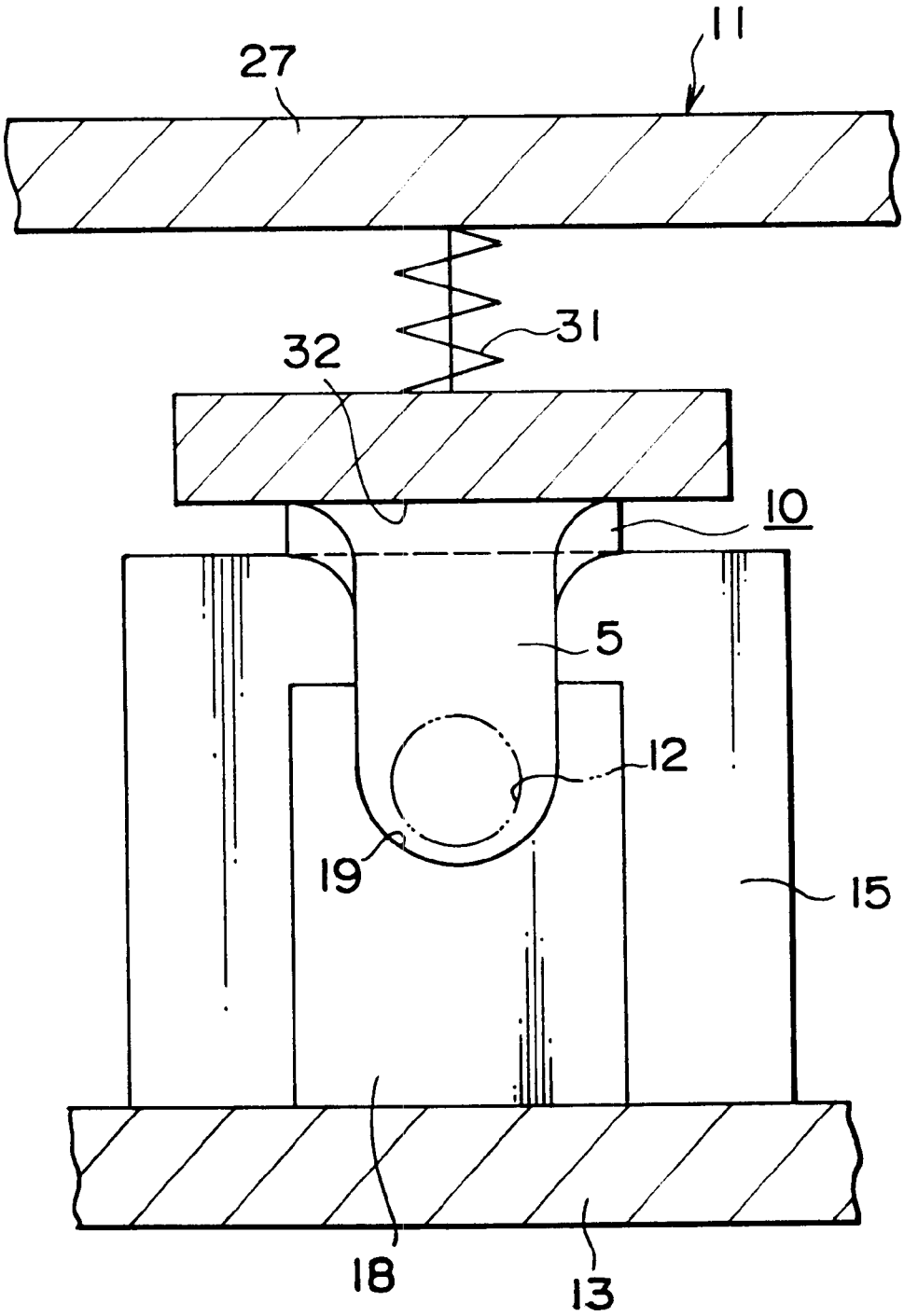
FIG. 2 is a cross section taken along A—A in FIG. 1.

FIGS. 1 to 6 show an embodiment of the present invention. When the yoke for universal joint of the present invention is to be produced, first a steel sheet which has been punched into a predetermined shape is pressed into a U shape to form a pair of arms 5, 5 which are substantially parallel to each other, to thus producing a first yoke element 10 (FIGS. 1 and 2). In the central portion of this first yoke element 10, a fixture hole 29 for fitting and fixing the end portion of a steering shaft 2 (FIG. 7) is formed by punching. The accuracy required for this fixture hole 29 is not very high. Therefore, this fixture hole 29 is formed by normal press working at the same time when the steel sheet is pressed into the predetermined shape, or after the first yoke element 10 is formed. A process of producing such first yoke element 10 itself has been widely employed conventionally to produce a yoke for a universal joint and is well known. Thus, the illustration and detailed description of this process will be omitted. The present invention is characterized in that the mutually concentric circular holes 6, 6 are formed with accuracy by press working at the tip ends of the paired arms 5, 5 which constitute the first yoke element 10. The steps of producing the mutually concentric circular holes 6, 6 at the tip ends of the paired arms 5, 5 will be described in the following.

Figure 3:
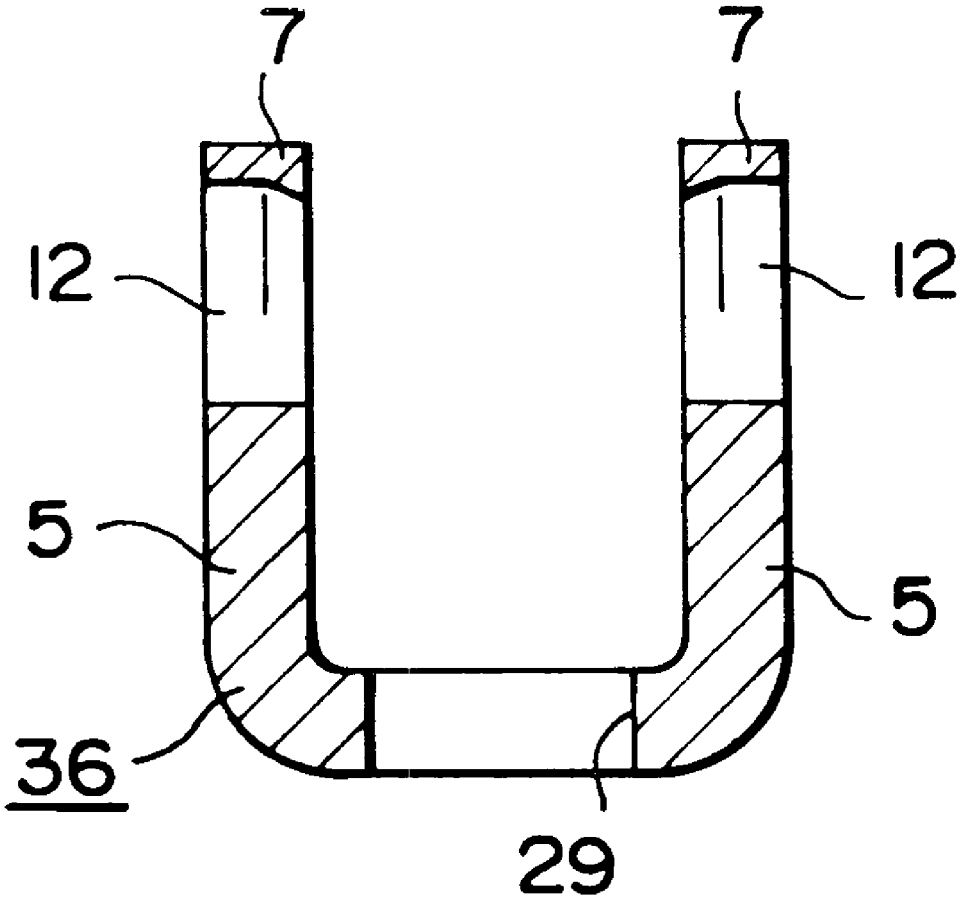
FIG. 3 is a cross section of a second yoke element.

This first yoke element 10 is first set in a punching machine 11 as shown in FIGS. 1 and 2, to form blank holes 12, 12 (circular holes) as shown in FIG. 3 at the tip ends of the arms 5, 5. The punching machine 11 is provided on a base plate 13 having sufficient rigidity. In the central portion of this base plate 13, there is formed an discharge hole 14 for discharging punching refuse which is generated when the blank holes 12, 12 are punched. Then, a die 15 is fixed to the upper surface of the base plate 13 so as to cover the upper end opening of this discharge hole 14. The thickness T15 of this die 15 is made to be substantially the same as the distance D5 between the inner faces of the paired arms 5, 5 ($T15 \approx D5$) so that the die can be freely inserted without play between the paired arm portions 5, 5 for constituting the first yoke element 10. Accordingly, in the state that the first yoke element 10 is fitted on and fixed to the die 15, the inner face portions of the paired arms 5, 5 for constituting the first yoke element 10, tightly abut on the outer surface of the die 15 over the entire inner face portions.

In this die 15, a receiving hole 16 which has a much larger internal diameter R16 than the internal diameter R12 of the blank holes 12, 12 ($R12<R16$) is formed in parallel with the upper surface of the base plate 13 in the state that this receiving hole extends through the both ides of die 15. Further, a discharge through hole 17 is formed between the lower surface of the intermediate portion of the receiving hole 16 and the discharge hole 14, so that the punching refuse confined in the receiving hole 16 can be freely discharged through the discharge hole 14.

Restraining plates 18, 18 which serve as restraining dies are fixed to both sides of the die 15. These restrain plates 18, 18 are respectively used to restraining the outer periphery of the arms 5, 5 in the vicinity of the portions for forming the blank holes 12, 12, i.e., in the tip half portions of the arms 5, 5. U-shaped notches 19, 19 are respectively formed in the central parts of the upper edges of such plates 18, 18.

Openings at both ends of the receiving hole 16 are positioned in the central parts of these notches 19, 19.

The shape of the inner periphery of each of the notches 19, 19 is made to conform to the shape of the outer periphery of the tip end of the arm 5, 5. Accordingly, in the state that the first yoke element 10 is fitted on and fixed to the die 15 and the tip half portions of the arms 5, 5 are advanced into the notches 19, 19, the inner peripheries of the notches and the outer peripheries of the tip half portions of the arms 5, 5 are contacted to each other tightly over,the entire length thereof.

At a position for laterally sandwiching the die 15 on the upper surface of the base plate 13, there are provided sliders 21, 21 each for holding and fixing a punching punch 20 so as to be freely movable toward and away relative to the die 15. Each of these sliders 21, 21 is formed by laying a principal plate 22 on a secondary plate 23 and connecting and fixing them to each other by use of a screw, or the like. The punch 20 is passed through the central portion of the principal plate 22, and the head portion 24 thereof is sandwiched by this principal plate 22 and the secondary plate 23. Thus, the base portions of these plates are fixed to the sliders 21, 21, respectively. Note that these sliders 21, 21 are slidably moved in the axial direction of the punches 20, 20 (in the lateral direction in FIG. 1). The punches 20, 20 and the receiving hole 16 are formed along the same axis. The distance between the sliders 21, 21 is larger than that illustrated in FIG. 1, unless the external force acts thereupon due to the elasticity of an unrepresented return spring.

Side restraining blocks 25, 25 are fitted on the portions near the tip ends of the punches 20, so as to be only slidable along the axial direction of these punches 20, 20. Compression springs 26, 26 are provided between the outside faces of the side restraining blocks 25, 25 and the inside faces of the sliders 21, 21, respectively. Therefore, in the state that the sliders 21, 21 are advanced toward the die 15 in order to form the blank holes 12, 12 at the tip ends of the arms 5, 5, the arms 5, 5 are elastically pressed by both of the restraining blocks 25, 25 between the restraining blocks 25, 25 and the outside faces of the die 15.

Meanwhile, a pressing plate 27 is provided to freely ascend and/or descend above the base plate 13 while maintaining a horizontal posture. This pressing plate 27 is provided at a higher position than that shown in FIGS. 1 and 2, unless the external force acts upon it due to the elasticity of the unrepresented return spring. On the other hand, when the punching work is to be conducted to form the blank holes 12, 12, the pressing plate is strongly pressed downward to a lower position than that shown in FIGS. 1 and 2 by a ram of a press working machine which is also unrepresented. In the central part of the lower surface of such pressing plate 27, an upper restraining block 30 is supported to freely ascend and/or descend relative to this pressing plate 27, and compression springs 31, 31 are provided between the upper surface of this upper restraining block 30 and the lower surface of the pressing plate 27. A restraining recess 32 is formed on the lower surface of the upper restraining block 30. The shape of the inner face of this restraining recess 32 is made to conform to the shape of the outer periphery of the base end portion of the first yoke element 10. Accordingly, in the state in which the pressing plate 27 is made to descend and this base end portion of the first yoke element 10 is fitted in the restraining recess 32, the inner face of this restraining recess 32 and the outer periphery of the base end portion of the first yoke element 10 are contacted to each other without clearance.

Further, upper slide blocks 33, 33 are respectively fixed to both ends of the lower surface of the pressing plate 27. The inside faces which are the lower half portions of the upper slide blocks 33, 33 and are mutually opposite respectively become driving inclined surfaces 34, 34. A distance between the driving inclined surfaces 34, 34 which are respectively formed on the upper slide blocks 33, 33 becomes larger as it goes lower. On the other hand, on the outside faces of the upper end portions of the principal plates 22, 22 which constitute the paired sliders 21, 21, there are formed driven inclined surfaces 35, 35 which are slidably contacted to the driving inclined surfaces 34, 34 tightly. 20 Based on the engagement between the driving inclined surfaces 34, 34 and the driven inclined surfaces 35, 35, the pair of sliders 21, 21 slide toward each other on the upper face of the base plate 13, together with the lowering of the pressing plate 27.

The formation of the blank holes 12, 12 at the tip ends of the pair of arms 5, 5 which constitute the first yoke element 10 will be conducted as follows by the punching machine 11 arranged as described above. In the state in which the punching machine 11 is set in a press machine, the first yoke element 10 is fitted on the upper half portion of the die 15 first, as shown in FIGS. 1 and 2, then the pressing plate 27 is pressed downward by the ram of the press machine. As a result, the upper restraining block 30 presses the first yoke element 10 upon the upper end face of the die 15. Based on this pressing, the outer periphery of the tip end of each of the arms 5, 5 is pressed upon the inner periphery of the notch 19, 19 formed on the upper end portion of each of the restraining plates 18, 18, owing to the elasticity of the compression spring 31.

Based on the engagement between the driving inclined surfaces 34, 34 and the driven inclined surfaces 35, 35, the pair of sliders 21, 21 are horizontally moved toward each other. Then, each of the side restraining blocks 25, 25 presses each of the arms 5, 5 upon the outside face of the die 15, due to the elasticity of the compression springs 26, 26. When the pressing plate 27 is made to further descend continuously and the pair of sliders 21, 21 are made to move further toward each other from this state, the pair of punches 20, 20 strongly press the tip ends of the arms 5, 5 so as to punch the blank holes 12, 12 as shown in FIG. 3, at the tip ends thereof.

When the blank holes 12, 12 are thus formed by the punches 20, 20, the portions to become the tip end partition walls 7, 7 each having a small width and portions around these blank holes 12, 12 are restrained in a certain direction in which the diameter thereof does not expand, by the notches 19, 19 of the blocks 18, 18. The portions to become the tip end partition walls 7, 7 are also restrained in a plane direction by the die 15 and the side blocks 25, 25. Accordingly, at the time of the punching work of the blank holes 12, 12, the accuracy (in configuration and dimensions) of these blank holes 12, 12 is increased.

However, the accuracy required for the circular holes 6, 6 (FIG. 6) of the yoke for universal joint can not be securely obtained by the punching work only by the punches 20, 20. Specifically, though the accuracy of the outer half surfaces of the arms 5, 5 into which these punching punches 20, 20 are inserted can be sufficiently obtained, the accuracy of the inner half surface on the opposite side is difficult to securely obtain. Then, taking the finishing work to be described later into consideration, the working conditions on the configuration of the blank holes 12, 12 are adjusted in such a manner that the inner diameter on the inside surface of the arm 5 is smaller than the inner diameter on the outside surface thereof. Such adjustment of the working conditions can be conducted by changing a difference between the outer diameter of the each punch 20, 20 and the inner diameter of the receiving hole 16 of the die 15, and the configuration of the tip end of each punch 20, 20.

Figure 4:
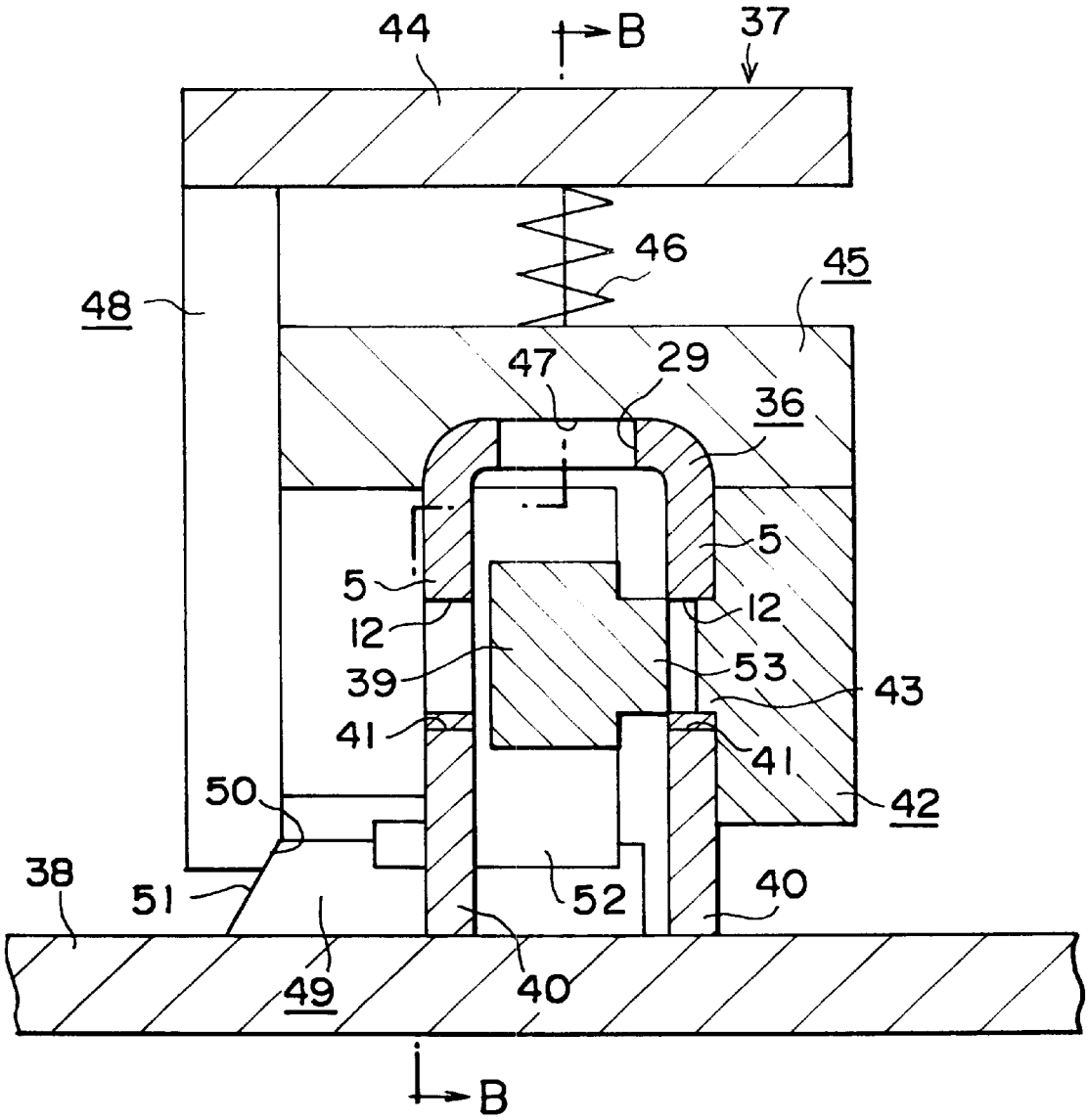
FIG. 4 is a longitudinal cross sectional view of a finishing machine for finishing the holes formed in the second yoke element.
Figure 5:
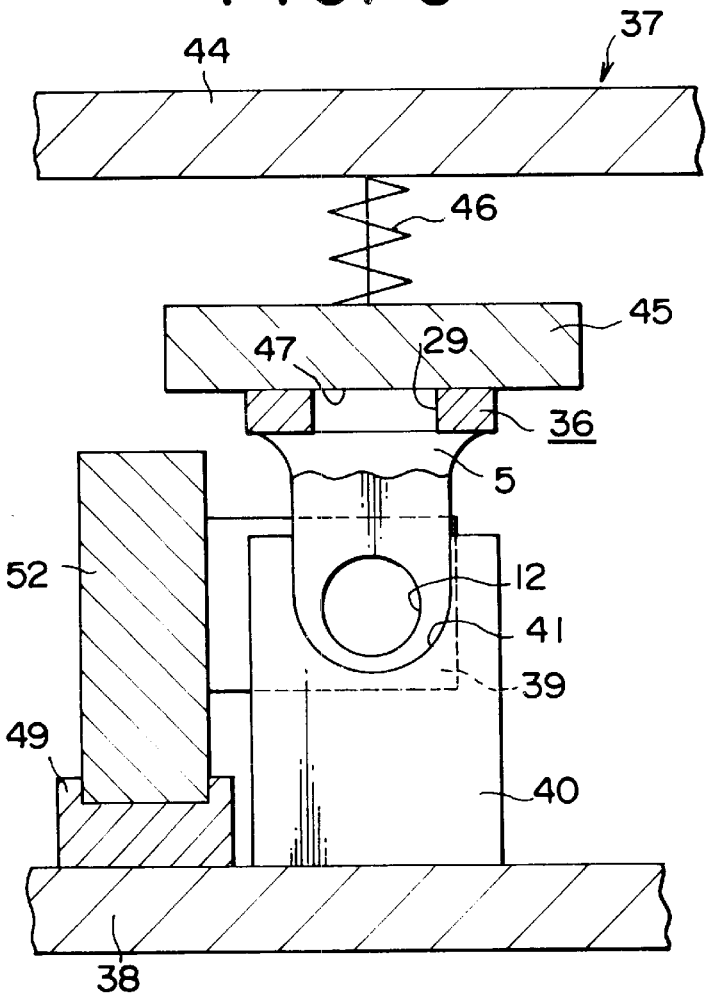
FIG. 5 is a cross section taken along B—B in FIG. 4.

After the blank holes 12, 12 as described above are formed in the first yoke element 10 by use of the punching machine 11 to obtain a second yoke element 36 as shown in FIG. 3, the second yoke element 36 is subjected to the finish working called restrike, by use of a finish machine 37 as shown in FIGS. 4 and 5. This finish machine 37 is provided on base plate 38 which also has a sufficient rigidity. A finish punch 39 is pushed into the inner half surfaces of the blank holes 12, 12 formed on the tip ends of the arms 5, 5 for constituting the second yoke element 36, so that the inner half side surfaces of the blank holes 12, 12 can be finished to have the equal accuracy to those of the outer half surfaces. As a result, holes each having an inner peripheral surface with a largely reduced break portion can be obtained. Note that the finish punch 39 is required to be pushed into the blank holes 12, 12 from the inner surfaces of the arms 5, 5. Thus, for the reason of space, the finish working is conducted separately for each of the blank holes 12, 12 (time-sequentially).

In order.to construct the finish machine 37 for conducting the finish working, a pair of support plates 40, 40 each having the same configuration as that of the restraining plate 18, 18 for constituting the punching machine 11 (FIGS. 1 and 2) are fixed to the central portion of the upper surface of the base plate 38, with a gap therebetween which is the same as that between the pair of arms 5, 5 for constituting the second yoke element 36. Then, the tip ends of the arms 5, 5 are tightly fitted in and freely supported by the notches 41, 41 which are formed on the upper edge portions of the support plates 40, 40. A centering block 42 is connected and fixed to the outer half surface of one of the support plates 40 (the right one in FIG. 4). A circular convex portion 43 is formed in a portion on the inside surface of this centering block 41 and inside the notch 41. The outer diameter of this circular convex portion 43 is made to conform to the inner diameter of the outer half surface of the blank hole 12, so that this circular convex portion 43 can be fitted in the outer half surface of the blank hole 12 without play. However, it is possible to taper the tip end of this circular convex portion 43 in order to smoothly fit the circular convex portion 43 in the blank hole 12. In the state in which the circular convex portion 43 is being fitted to the outer half surface of the blank hole 12, the position at which the centering block 42 is connected and fixed relative to the support plate 40 is restricted in such a manner that the outer periphery of the tip end of the arm 5 and the inner periphery of the notch 41 are brought into close contact.

Meanwhile, a pressing plate 44 is provided to freely ascend and/or descend above the base plate 38 while maintaining a horizontal posture. This pressing plate 44 is provided at a higher position than that shown in FIGS. 4 and 5, unless the external force acts upon it due to the elasticity of the unrepresented return spring. On the other hand, when the finishing work is to be conducted on the blank hole 12, the pressing plate is strongly pressed downward to a position further lower than that shown in FIGS. 4 and 5, by the ram of the press working machine which is also unrepresented. In the central part of the lower surface of such pressing plate 44, an upper restraining block 45 is supported to ascend and/or descend relative to this pressing plate 44, and compression spring 46 is provided between the upper surface of this upper restraining block 45 and the lower surface of the pressing plate 44. A restraining recess 47 is formed on the lower surface of the upper restraining block 45. The shape of the inner face of this restraining recess 47 is made to conform to the shape of the outer periphery of the base end portion of the second yoke element 36. Accordingly, in the state in which the pressing plate 44 is made to descend and the base end portion of the second yoke element 36 is fitted in the recess 47, the inner face of this recess 47 and the outer periphery of the base end portion of the second yoke element 36 are contacted to each other without clearance.

Further, the upper end of a pressing arm 48 is connected and fixed to one corner on the lower surface of the pressing plate 44 (the left corner in FIG. 4).

A slider 49 is provided on the upper surface of the base plate 38 along the sides of the pair of support plates 40, 40 to allow free displacement along the direction of arrangement of the support plates 40, 40. This slider 49 is provided at a position slightly to the left of the position shown in FIG. 4, unless the external force gives influence thereon due to the elasticity of the unrepresented return spring. A driving inclined surface 50 is formed at the lower end of the pressing arm 48 and a driven inclined surface 51 is formed on the base end surface of the slider 49 (the left end surface in FIG. 4), respectively, so that these inclined surfaces 50, 51 are slidably engaged with each other. The slider 49 is displaced to resist the elasticity of the return spring in a direction in which the slider 49 retracts from this pressing plate 44 (the right direction of FIG. 4) when the pressing plate 44 descends based on the engagement between these inclined surfaces 50 and 51.

A support plate 52 is connected and fixed to the upper surface of such slider 49, and a base end portion of the finish punch 39 (the left end portion in FIG. 5) to the side surface of this support sheet 52. Note that a finish convex portion 53 which is formed on the front side surface of this finish punch 39 (the right side surface in FIG. 4) has the same diameter as that of the circular convex portion 43 which is formed in the centering block 42 and the finish convex portion 53 is provided to be coaxial with this circular convex portion 43. In addition, a chamfering portion having an arched cross section is provided on the outer periphery of the tip end of the finish convex portion 53, so that this finish convex portion 53 can be easily pushed into the blank hole 12.

The finish working of the inner half surfaces of the blank holes 12, 12 which are formed at the tip ends of the paired arms 5, 5 for constituting the second yoke element 36 is conducted by the finish machine 37 arranged as described above in the following manner. First, in the state in which the finish machine 37 is set in the press machine, the second yoke element 36 is first interlocked with the pair of support plates 40, 40 and the centering block 42, as shown in FIGS. 4 and 5. This interlocking is conducted while the second yoke element 36 is horizontally moved from left to right in FIG. 4. After the second yoke element 36 is interlocked in such manner, the pressing plate 44 is pressed downward by the ram of the press machine. As a result, the upper restraining block 45 presses the second yoke element 36 onto the inner peripheries of the notches 41, 41 formed on the paired support plates 40, 40. Note that this pressing force due to the elasticity of the compression spring 46 is weak, as compared to the restraining force of the upper restraining block 30 of the punching machine 11 used upon the first yoke element 10 described above.

Figure 6:
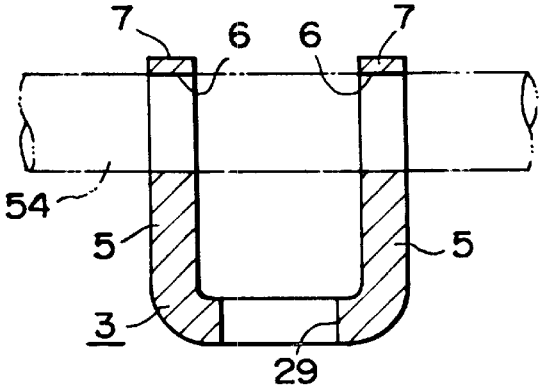
FIG. 6 is a cross section of a completed yoke.
Figure 7:
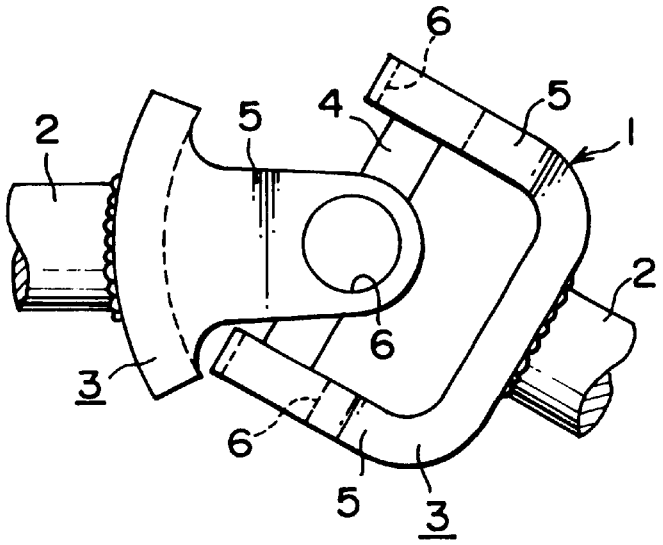
FIG. 7 is a side view of an assembled universal joint
Figure 8:
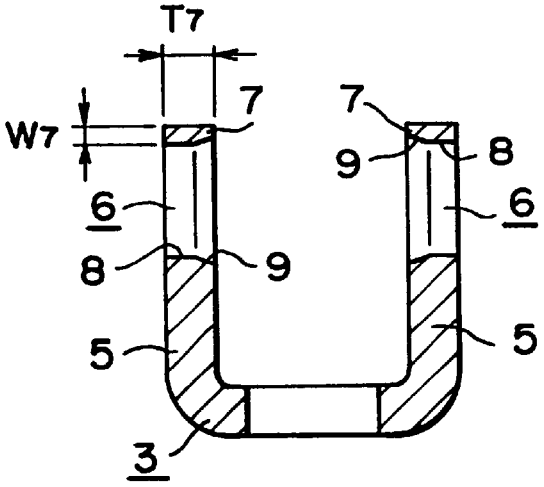
FIG. 8 PRIOR ART
FIG. 8 is a cross sectional view of a yoke formed with circular holes by a general press working.

Based on the engagement between the driving inclined surface 50 and the driven inclined surface 51, the slider 49 is displaced horizontally and the finish punch 39 is moved horizontally in a direction toward the centering block 42. Then, the finish convex portion 53 provided in this finish punch 39 is advanced to the inner half surface of the blank hole 12, to finish the inner periphery of this inner half surface into a configuration which is conforming to that of the outer periphery of the finish convex portion 53. As a result, the inner half surface of the blank hole 12 is made to have a configuration conforming to the outer half surface thereof, so as to be completed as a yoke having circular holes 6, 6 with a desired accuracy, as shown in FIG. 6. Note that the configuration of the finish convex portion 53 may be a true circle, or may be slightly different from a true circle such as being elliptical, taking into consideration the elastic restoration, or the like, when in the pressing force due to the elasticity of the compression spring 46 is released.

Inside the pair of circular holes 6, 6 which are formed at the tip ends of the arms 5, 5 of the yoke 3 of the present invention produced as described, a shaft 54 which has a slightly smaller that diameter an inner diameter of the circular hole 6, 6 can be inserted, as shown in FIG. 6, so as to comprehensively examine the mutual coaxiality, circularity, hole inclination, size accuracy including the internal diameter size, and accuracy in configuration of these holes 6, 6. The shaft 54 can have the outer diameter nearer to the internal diameter of the circular hole 6, 6 as the above-mentioned accuracies for these circular holes 6, 6 are higher. In other words, as a difference between the outer diameter of the shaft 54 to be inserted and the internal diameter of the circular hole 6, 6 is smaller, the accuracies for these circular holes 6, 6 are higher. According to the experiments conducted by the present inventors, when the present invention is applied, this difference can be reduced to about half (the difference is about 0.025 mm ) of that of a yoke which is produced by a conventional process (the difference is about 0.04 mm in this case). For the other items examined, the hole size range to 0.018 mm (by the process of the present invention) from 0.045 mm (by the conventional process), an elliptic amount of the hole size to 0.02 mm (by the process of the present invention) from 0.03 mm (by the conventional process), the minimum value of the sheared section area to 85% (by the process of the present inventions from 70% (by the conventional process), the maximum value of the sheared section area to 15% (by the process of the present invention) from 30% (by the conventional process), etc. As confirmed by these and other examined items, according to the present invention, more desirable values can be obtained, as compared to those obtained by the conventional process. Thus, the yoke of the present invention is better suited for use in a steering apparatus of an actual automobile, as a universal joint yoke produced by conventional press working. Note that the material used in producing the yoke in the above experiments is SPHC (JIS G 3131), the sheet thickness is 6.00 mm, the internal diameter of the circular hole 6 is 16 mm, and the width of the tip end partition wall 7 is 3.0 mm.

The yoke for a universal joint and the process for producing such yoke of the present invention are arranged and effected as described above, so that circular holes for supporting the end portions of a cross shaft can be formed with high accuracy by press working which can be conducted at low cost, thereby contributing to the production of an inexpensive universal joint with high performance.

What is claimed is:

1. A yoke for a universal joint which is produced by press forming a steel sheet to have a pair of opposed arms and then by press punching tip end portions of the arms to have mutually coaxial circular holes opposed to each other, wherein said circular holes are formed by a process including:

punching a pair of coaxial provisional circular holes through the respective tip end portions of said arms in a state in which each arm has a back surface, relative to a provisional punching direction of the arm, supported by a die with an outer periphery of the arm being fitted in and restrained by a restraining member in a vicinity of a portion in which the corresponding provisional circular hole is formed; and finish punching the provisional circular hole of each arm by inserting a finishing punch into the provisional circular hole in a finish punching direction opposite to said provisional punching direction of the arm in a state in which a back surface of the arm, relative to the finish punching direction, is supported by a die and the outer periphery of the arm is fitted in and restrained by a restraining member in a vicinity of the provisional circular hole, so as to produce a finished circular hole having inner-half and outer-half surfaces of substantially equal accuracy.

2. The invention of claim 1 wherein the finishing punch is inserted only part-way into the provisional circular hole.

3. In a method of forming a yoke for a universal joint with mutually coaxial circular holes by press punching tip end portions of a pair of opposed arms of a yoke work-piece which is produced by press forming a metal sheet blank to form said pair of opposed arms, the improvement wherein said circular holes are formed by a process including:

punching a pair of coaxial provisional circular holes through the respective tip end portions of said arms in a state in which each arm has a back surface, relative to a provisional punching direction of the arm, supported by a die with an outer periphery of the arm being fitted in and restrained by a restraining member in a vicinity of a portion in which the corresponding provisional circular hole is formed; and finish punching the provisional circular hole of each arm by inserting a finishing punch into the provisional circular hole in a finish punching direction opposite to said provisional punching direction of the arm in a state in which a back surface of the arm, relative to the finish punching direction, is supported by a die and the outer periphery of the arm is fitted in and restrained by a restraining member in a vicinity of the provisional circular hole, so as to produce a finished circular hole having inner-half and outer-half surfaces of substantially equal accuracy.

4. The invention of claim 3, wherein the finishing punch is inserted only part-way into the provisional circular hole.

5. The invention of claim 3, wherein the provisional circular holes are formed by inserting a pair of punches respectively through the tip end portions of said arms, said punches being inserted in opposite directions from outside said arms.

6. The invention of claim 5, wherein the punching of each provisional circular hole is performed such that an inner side surface of the provisional circular hole has a smaller diameter than an outer side surface thereof.

7. A yoke for a universal joint which is produced by press forming a steel sheet to have a pair of opposed arms and then by press punching tip end portions of the arms to have mutually coaxial circular holes opposed to each other, wherein said circular holes are formed by a process including:

punching a pair of coaxial provisional circular holes through the respective tip end portions of said arms in a state in which each arm has a back surface, relative to a provisional punching direction of the arm, supported by a die with an outer periphery of a tip end portion of the arm being fitted in and restrained by a complementarily shaped portion of a restraining member; and finish punching the provisional circular hole of each arm by inserting a finishing punch into the provisional circular hole in a finish punching direction opposite to said provisional punching direction of the arm in a state in which a back surface of the arm, relative to the finish punching direction, is supported by a die and the outer periphery of the tip end portion of the arm is fitted in and restrained by a complementarily shaped portion of a restraining member, so as to produce a finished circular hole having inner-half and outer-half surfaces of substantially equal accuracy.

8. The invention of claim 7, wherein the finishing punch is inserted only part-way into the provisional circular hole.

9. In a method of forming a yoke for a universal joint with mutually coaxial circular holes by press punching tip end portions of a pair of opposed arms of a yoke work-piece which is produced by press forming a metal sheet blank to form said pair of opposed arms, the improvement wherein said circular holes are formed by a process including:

punching a pair of coaxial provisional circular holes through the respective tip end portions of said arms in a state in which each arm has a back surface, relative to a provisional punching direction of the arm, supported by a die with an outer periphery of a tip end portion of the arm being fitted in and restrained by a complementarily shaped portion of a restraining member; and finish punching the provisional circular hole of each arm by inserting a finishing punch into the provisional circular hole in a finish punching direction opposite to said provisional punching direction of the arm in a state in which a back surface of the arm, relative to the finish punching direction, is supported by a die and the outer periphery of the tip end portion of the arm is fitted in and restrained by a complementarily shaped portion of a restraining member, so as to produce a finished circular hole having inner-half and outer-half surfaces of substantially equal accuracy.

10. The invention of claim 9, wherein the finishing punch is inserted only part-way into the provisional circular hole.

11. The invention of claim 9, wherein the provisional circular holes are formed by inserting a pair of punches respectively through the tip end portions of said arms, said punches being inserted in opposite directions from outside said arms.

12. The invention of claim 11, wherein the punching of each provisional circular hole is performed such that an inner side surface of the provisional circular hole has a smaller diameter than an outer side surface thereof.

* * * * *